US005601605A

United States Patent [19]

Crowe et al.

[11] Patent Number: 5,601,605

[45] Date of Patent: Feb. 11, 1997

[54] INFANT PACIFIER - FLUID ADMINISTERING UNIT

[76] Inventors: Dewey E. Crowe; Sarah Barron, both of 808 E. Eighth Ave., Johnson City, Tenn. 37601

[21] Appl. No.: 521,121

[22] Filed: Aug. 29, 1995

[51] Int. Cl.[6] ..... A61J 17/00; A61J 7/00

[52] U.S. Cl. ..... 606/236; 604/77

[58] Field of Search ..... 606/234–236; D24/194–199; 604/77, 79, 210, 212, 213, 76; 222/92, 96, 400.7, 422, 490

[56] References Cited

U.S. PATENT DOCUMENTS 39,662 8/1863 Lockwood ..... 604/213

404,950 6/1989 Barnes ..... 606/234

716,526 12/1902 Eddy ..... 604/212

5,431,680 7/1995 Jones ..... 606/236

*Primary Examiner*—Glenn Dawson

[57] ABSTRACT

An infants pacifier and medicine administering unit having a generally shield-shaped body having first and second sides and having an aperture extending therethrough around a generally transverse axis. The aperture is defined by a wall of the body. A flexible nipple having an inlet end and sucking orifice spaced therefrom, and a fluid dispenser having an outlet end, are mounted on opposite sides of the body with the inlet and the outlet being juxtaposed for fluid communication with each other whereby fluid in the dispenser can be injected under pressure into the nipple.

9 Claims, 1 Drawing Sheet

INFANT PACIFIER - FLUID ADMINISTERING UNIT

FIELD OF THE INVENTION

This invention concerns a unique technique and structural means for facilitating the administration of a medicinal or other dosage of fluid material to an infant. The invention particularly concerns a novel structural adaption of conventional infant pacifier structure, for performing this technique in a non-invasive essentially non-irritating manner.

1. Background Of The Invention

The forced feeding of medicines or the like to infants, of any species, can be a nerve-wracking experience and usually produces less than a satisfactory result. One technique which is used is the sudden ejection method wherein a medicine dropper is used to eject the medicine directly and brutally into the innocent, unsuspecting, gaping mouth of the infant. Trauma typically results and a repeat, passive acceptance by the infant of the noxious material should not be expected. Other subterfuges such as mixing the bad tasting substance into the infants milk likewise has its drawbacks, such as, e.g., making your baby hate milk.

2. Brief Discussion Of Prior Art

Heretofore, various devices have been preferred for dispensing fluid materials by nipple means simulating a pacifier, as shown in U.S. Pat. Nos. 5,013,321; 5,176,705; 5,078,734; 2,612,165; 2,889,829, the disclosure of which concerning structure rention means, materials of construction, and utility are hereby incorporated herein by reference. Such prior devices neither perform in the same manner and with equivalent efficiency as applicants unit, nor are they structurally similar thereto.

Objects therefore, of the present invention are: to provide a means for administering medicines or other unpleasant tasting substances to infants whereby the bad aspects of the experience are reduced to a minimum; to provide such a means in a form which is familiar to the infant such that the administration process is substantially unnoticeable to the infant; to provide such means in a convenient form, size and construction which is extremely easy to use, clean, refill and reuse; and to provide such means in an economical and easy to manufacturable form.

BRIEF SUMMARY OF THE INVENTION

The above and other objects hereinafter becoming evident have been attained in accordance with the present invention thru the discovery which is expressed in a broad embodiment as an infants pacifier-fluid dispenser unit comprising a generally shield-shaped stop member having first and second sides and having aperture means formed laterally therethrough along a generally transverse axis of said member and defined by transverse wall means, nipple means having an inlet end mounted on said stop member adjacent said aperture means and having an outlet end with sucking orifice means spaced from said first side generally along said transverse axis, fluid dispenser means providing fluid reservoir means and having an outlet therefor, said dispenser means being mounted on said stop member and adapted to be operated to place said reservoir means into fluid communication with said inlet end of said nipple means and cause a pressurized flow of fluid from said reservoir means to said nipple means.

In certain preferred embodiments:

(a) said wall means is generally of tubular configuration and lies intermediate said reservoir means and said nipple means, and normally closed pressure responsive valve means is provided within said wall means and is openable in response to compression of said bulb means to force fluid in said bulb means through said valve means and into said nipple means and out of the sucking orifice thereof;

(b) said nipple means and dispenser means comprises an elongated single element wherein the mid-region thereof being affixed to said stop member within said wall means.

(c) valve means is positioned within said wall means and is operative to allow pressurized fluid to flow from said reservoir means into said nipple means;

(d) said valve means is positioned on said unit at any position intermediate said reservoir means and said sucking orifice means;

(d) said valve means comprises an expandable, resilient elastomeric segment having normally closed orifice means therethrough, which orifice means becomes opened upon expansion of said member under pressure applied thereagainst;

(e) said valve means is positioned in the outlet end of said bulb means;

(f) said valve means comprises a pressure rupturable member;

(g) said dispenser means comprises flexible, resilient bulb means which can be prefilled with medicinal or other fluid material and said valve means is positioned within the outlet of said reservoir means; and (h) said bulb means is sufficiently resilient whereby upon being compressed and then released, its expansion will generate sufficient suction to draw fluid through said suction orifice means and into said nipple means, whether or not said valve means is present.

BRIEF DESCRIPTION OF THE DRAWINGS

The invention will be further understood from the following drawings and description thereof wherein certain portions of the drawings are enlarged for clarity and wherein.

DETAILED DESCRIPTION OF THE DRAWINGS

Figure 1:
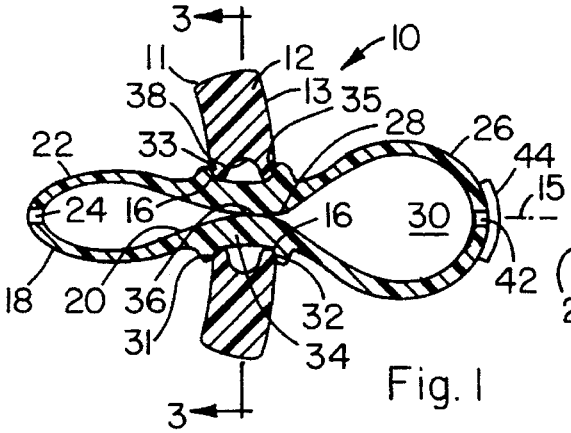
FIG. 1 is a transverse cross-sectional view of a unitary nipple-bulb dispenser embodiment of the present unit employing a reusable valve means.

Referring to the drawings, the present unit 10 in one preferred embodiment comprises a generally shield-shaped body or stop member 12 having first and second sides 11 and 13 respectively and having aperture means generally designated 14 formed therethrough around a generally transverse axis 15, said aperture means being defined by transverse or first wall means 16, nipple means 18 having an inlet end 20 mounted on said body member adjacent said aperture means and having an outlet end 22 with sucking orifice means 24 spaced from said first side 11 generally along said transverse axis, resilient, compressible bulb means 26 having an outlet end 28 mounted on said stop member and adapted to communicate with said inlet end 20 of said nipple means for allowing a pressurized flow of fluid 30 from said bulb means to said nipple means upon compression of said bulb means.

The wall means 16 is formed preferably to provide annular shoulder means 31, 32 adapted to be contacted by mating annular shoulder means 33, 35 respectively of the nipple means and bulb means for fixing the nipple means and bulb means in position on the body or stop member 12.

Figure 3:
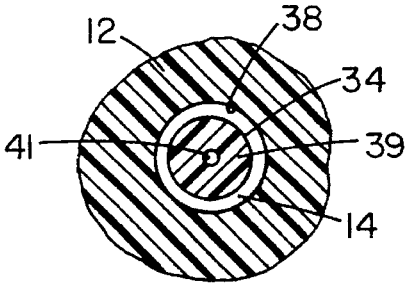
FIG. 3 is a cross-sectional view of a portion of the unit of FIG. 1 taken along line 3—3 thereof in the direction of the arrows, wherein the dispenser is pressurized and the valve means is opened thereby.
Figure 8:
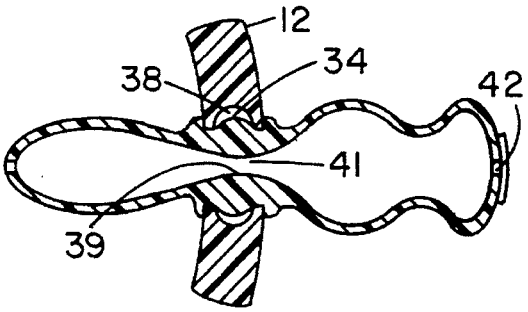
FIG. 8 is a view as in FIG. 1 with the dispenser bulb compressed and the valve means opened thereby.

In the embodiment of FIG. 1, the nipple means and bulb means jointly comprise a unitary, substantially hermetically sealed element having a longitudinal mid-region 34 of annular cross section which may be thickened for providing a normally closed sealable valve means 39 having orifice means 41. This valve means is adapted to become opened as shown in FIG. 3 and 8 only by significantly pressurizing bulb means 26 or an equivalent dispenser means, wherein said mid-region 34 is partially radially deformed outwardly into annular recess means 38 formed into wall means 16. This construction provides a reusable valve means.

Either or both of the bulb means or nipple means of the unit can be calibrated with measurement lines to control the amount of medicine to be administered. In one embodiment, the medicine is suctioned up into the nipple through squeezing and then relaxing the bulb. Alternatively, the nipple means can be screwed or otherwise affixed to the body means and medicine can be added to the bulb wherein different size bulbs can be used if needed for different doses. The body or stop means 12 rests on the infants lips as it sucks the pacifier nipple and ingests the medicine.

Figure 9:
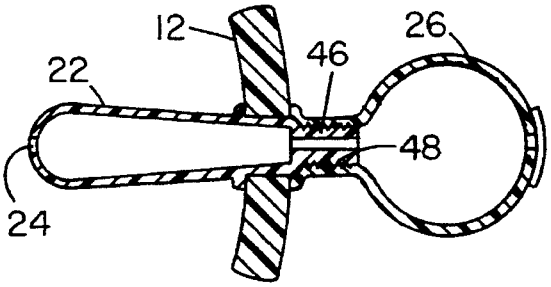
FIG. 9 shows an alternative connection of the nipple and bulb means to the body means.

The nipple and bulb can attach to the stop member through the aperture 14 by screwing the nipple and bulb together such as shown in FIG. 9 to provide a high degree of safety against the possibility of swallowing either part. In this embodiment, the threaded mating portions 46, 48 of the nipple and bulb means respectively may be thickened to provide sufficient rigidity thereto for making a firm and secure threaded connection therebetween. Medicine or other fluid in the nipple and reservoir means, or only in the nipple may be administered by either the baby sucking on the nipple or by squeezing the bulb, or both to facilitate transfer of the medicine into the baby's mouth.

Figure 7:
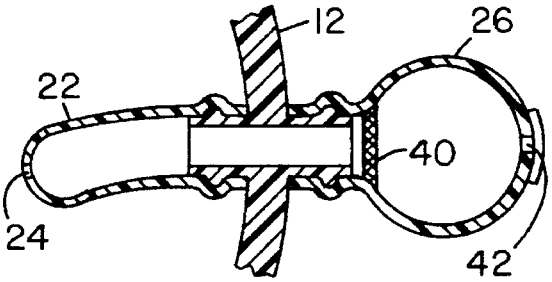
FIG. 7 is a view as in FIG. 4 showing placement of a rupturable, single use valve means in the outlet of the dispenser bulb means.

In FIG. 7 the valve means comprises a simple pressure rupturable membrane 40 which may be adhesively secured or plastic welded or the like within the wall means 16 or a portion of the bulb means or nipple means.

In each of the embodiments shown the dispensing means, e.g., bulb means 26 may be provided with a fill port 43 provided, for example, with an adhesive flap cover such as 44 for sealing the fluid contents within the dispenser reservoir. The dispenser may alternatively comprise a fluid containing cylinder affixed at its outlet end to member 12 and provided with a piston type plunger for pressurizing the fluid to be administered through the valve means and through the nipple means, in the nature of a hypodermic syringe.

Figure 2:
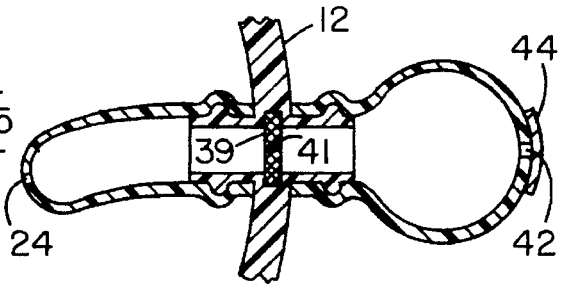
FIG. 2 is a view as in FIG. 1 of an assembleable nipple and dispenser embodiment of the present unit including a variation of the reusable valve means.
Figure 4:
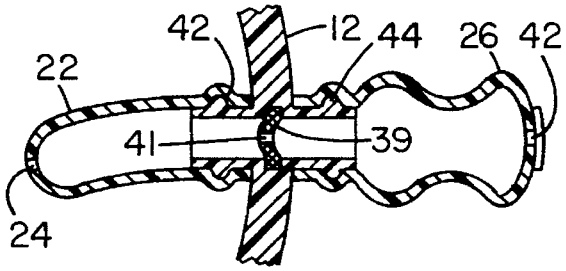
FIG. 4 is a cross-sectional view as in FIG. 2 showing the valve means in pressure-forced open position with the bulb means compressed.
Figure 5:
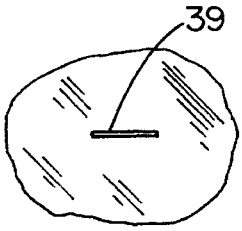
FIG. 5 is a tricuspid form of the valve of FIG. 4.
Figure 6:
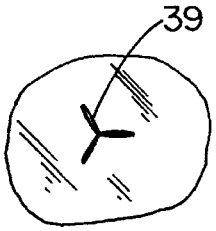
FIG. 6 is a bicuspid form of the valve of FIG. 4.

The structure employed for retaining the nipple means and dispenser on the stop member can be varied widely, as shown, for example, in FIGS. 2, 4, 7 wherein shoulder means 42, 44 are provided on the stop member and the nipple and dispensing means are tightly frictionally stretched thereover. Various other means such as the screw-on structure of FIG. 9 and those of the aforementioned patents may be employed herein for achieving such retention.

The invention has been described in detail with particular reference to preferred embodiments thereof, but it will be understood that variations and modifications will be effected with the spirit and scope of the invention.

We claim:

1. A fluid dosage administering unit comprising a generally shield shaped body means having first and second sides and having aperture means therethrough around a generally transverse axis, said aperture means being defined by first wall means, flexible nipple means in the form of an infants pacifier nipple having an inlet and a sucking orifice means spaced from said inlet; fluid dispenser means having fluid reservoir means and a fluid outlet therefor; said nipple means and dispenser means being provided as a single elongated elastomeric, substantially hermetically sealed element with a longitudinal mid-region thereof being frictionally mounted on said body means within said wall means in fixed position along said axis with said nipple means and said dispenser means being thereby positioned on opposite sides of said body means with said inlet and said outlet being adapted for fluid communication with each other whereby a passage is provided for placing said reservoir in fluid communication with said sucking orifice means and whereby medicine or other fluid in the nipple and reservoir means, or only in the nipple may be administered by either the baby sucking on the nipple or by squeezing the bulb, or both to facilitate transfer of the medicine into the baby's mouth; and wherein pressure responsive valve means is provided within said passage whereby fluid in said reservoir means is caused to flow through said valve means and out of said sucking orifice means only upon pressurizing the fluid in said reservoir means.

2. The unit of claim 1 wherein said body means and said element are provided with cooperating snap-together shoulder means whereby said element can be removably fixed in position along said axis.

3. The unit of claim 1 wherein said dispenser means is provided with port means for providing for filling of said reservoir means with fluid.

4. The unit of claim 1 wherein said dispenser means is in the form of compressible bulb means.

5. The unit of claim 4 wherein said bulb means is provided with sealable port means for providing for filling said bulb means with fluid.

6. The unit of claim 1 wherein said valve means is positioned within and affixed to said wall means.

7. The unit of claim 1 wherein said valve means comprises a deformable, resilient elastomeric segment of said mid-region normally closing said passage which becomes opened upon deformation of said segment by pressure applied thereagainst.

8. The unit of claim 7 wherein annular recess means is provided in said wall means of said body means into which said mid-region of said element is partially radially deformed by pressure within said passage.

9. The unit of claim 1 wherein said valve means is positioned in the outlet of said dispenser means.

* * * * *